United States Patent [19]

Johnson

[11] 3,985,232

[45] Oct. 12, 1976

[54] CARTON AND DISPLAY PANEL

[75] Inventor: Fred J. Johnson, Long Beach, Calif.

[73] Assignee: Container Corporation of America, Chicago, Ill.

[22] Filed: May 5, 1975

[21] Appl. No.: 574,386

[52] U.S. Cl. ..... 206/461; 229/38; 206/806

[51] Int. Cl.[2] ..... B65D 5/08

[58] Field of Search ..... 206/461, 462, 465, 45.31, 206/806; 229/15, 27, 38

[56] References Cited

UNITED STATES PATENTS

| | | | |
|---|---|---|---|
| 1,011,697 | 12/1911 | Witkowski | 206/462 |
| 3,166,229 | 1/1965 | Sherman et al. | 229/27 |
| 3,294,233 | 12/1966 | Hollinger | 229/15 |
| 3,358,820 | 12/1967 | Fairbairn | 206/45.31 |

*Primary Examiner*—William Price
*Assistant Examiner*—Douglas B. Farrow
*Attorney, Agent, or Firm*—Carpenter & Ostis

[57] ABSTRACT

A collapsible, combination folding carton and display panel formed from a one-piece blank of foldable paperboard wherein a portion of the display panel also serves as a portion of the carton.

1 Claim, 4 Drawing Figures

CARTON AND DISPLAY PANEL

BACKGROUND OF THE INVENTION

1. Field of the Invention

The invention relates to combination cartons and display panels, wherein a portion of the panel also serves as part of a carton having tuck flaps at opposite ends thereof.

2. The Prior Art

The prior art is exemplified by the following United States Patents developed in a recent search of the prior art:

| | | | |
|---|---|---|---|
| Sherman et al | 3,166,229 | January 19, 1965 | 229/27 |
| Champlin et al | 3,214,075 | October 26, 1965 | 229/16 |
| Nowak et al | 3,237,836 | March 1, 1966 | 229/16 |
| Gulliver | 3,301,389 | January 31, 1967 | 206/47 |
| Fairbairn | 3,358,820 | December 19, 1967 | 206/45.31 |
| Arneson | 3,361,330 | January 2, 1968 | 229/39 |
| Addiego | 3,416,656 | December 17, 1968 | 206/78 |
| Quenot | 3,459,298 | August 5, 1969 | 206/79 |
| Scott | 3,487,915 | January 6, 1970 | 206/46 |

SUMMARY OF THE INVENTION

This invention relates to combination carton and display panel wherein the carton is tubular in shape with tuck flaps and tabs for closing opposite ends of the carton.

It is an object of the invention to provide an arrangement of the type described wherein a portion of the display panel also serves as a rear wall of the integral carton.

A more specific object of the invention is the provision of an arrangement of the type described, wherein one wall of the carton is hinged to a retaining flap which in turn is sandwiched between a pair of facing sections of the display panel to facilitate machine closing of the carton tuck flaps and tabs by eliminating obstructions between the carton side walls.

These and other objects of the invention will be apparent from an examination of the following description and drawings.

THE DRAWINGS

It will be understood that, for purposes of clarity, certain elements may have been omitted from certain views where they are believed to be illustrated to better advantage in other views.

Figure 2:
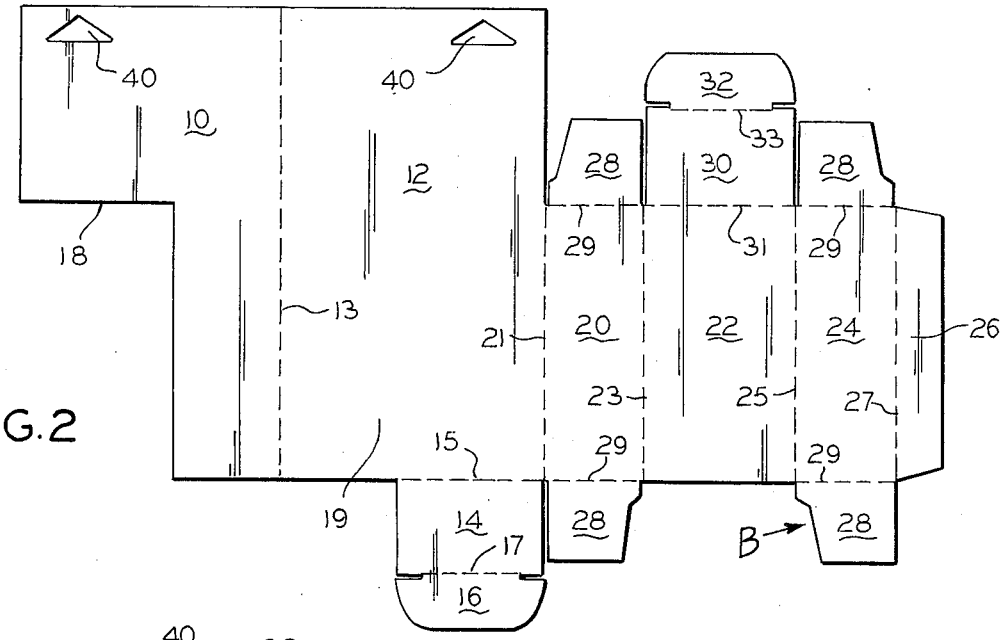
FIG. 2 is a plan view of a blank of paperboard from which the carton and panel of the other views may be formed.
Figure 1:
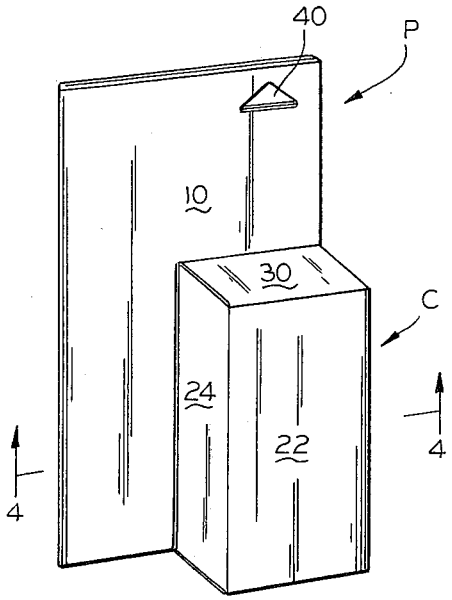
FIG. 1 is a perspective view of a combination carton and display panel embodying features of the invention, as shown in the erected and closed condition.
Figure 4:
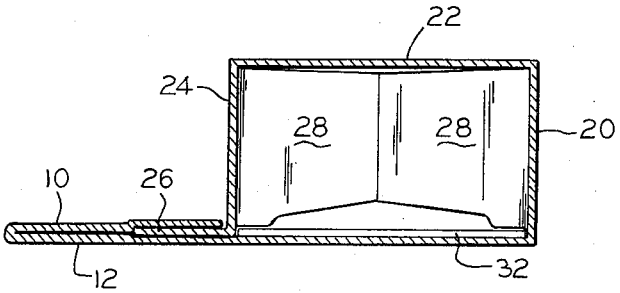
FIG. 4 is a horizontal section taken on line 4—4 of FIG. 1.

Referring now to the drawings, it will be seen that the novel combination carton C and display panel P, illustrated in FIG. 1 may be formed from the unitary blank of foldable paperboard or like material, indicated at B in FIG. 2.

The display panel P, as best seen in FIG. 1, includes a front section 10 which is foldably connected at its side edge to a corresponding side edge of a panel rear section 12 along a fold line 13. Front section 10 is disposed to overlie the rear section as best seen in the other views. Rear section 12 is preferably rectangular and front section 10 is of the same overall dimensions, except that a corner has been cut away, as at 18, to thereby expose a portion 19 of the rear section.

Foldably attached to the lower edge of panel rear section 12 is a closure flap 14, hinged to panel section 12 on fold line 15 and having foldably connected to its opposite edge on fold line 17 a tuck tab 16.

Again referring to FIG. 1, it will be seen that carton C, which is formed integrally with panel P, includes a generally rectangular front wall 22 which, when the carton is erected, is spaced above and overlies the exposed portion 19 of panel rear section, which portion also serves as the rear wall of the carton.

Front wall 22 is foldably connected at its outboard and inboard side edges along fold lines 23 and 25 to the forward edges of outboard and inboard side walls 20 and 24, respectively.

Outboard side wall 20 is foldably connected at its rear edge, on fold line 21, to the related side edge of panel rear section 12.

At its rear edge, inboard side wall 24 is foldably connected, on a fold line 27, to a relatively narrow, elongated retaining flap 26.

Side walls 20 and 24 each have opposed pairs of top and bottom side closure flaps 28 foldably connected to their upper and lower edges along fold lines 29.

Attached to the upper edge of front wall 22, on fold line 31, is an upper closure flap 30 which in turn has foldably joined thereto on fold line 33 a tuck tab 32.

Figure 3:
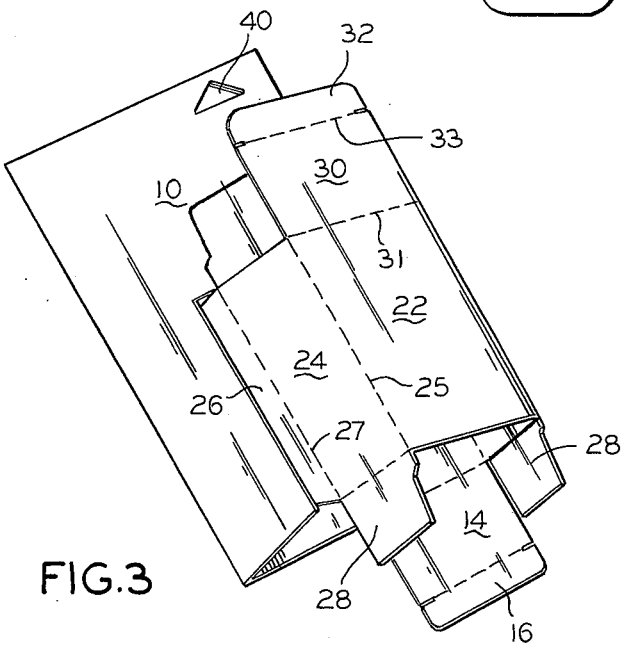
FIG. 3 is a perspective view similar to FIG. 1, but showing the carton and panel prior to completion of erection and gluing.

In forming carton C from blank B, front panel section 10 is folded over rear panel section 12 to lie in face-to-face contact therewith. At the same time, the carton is folded on fold line 23, as shown in FIG. 3, and retaining flap 26 is interposed between panel sections 10 and 12 and adhesively secured to both panel sections at a location immediately inboardly adjacent exposed portion 19 of panel rear section 12. Thus, the combination panel and carton when formed can be shipped in a collapsed condition.

When the carton is erected for filling and closing, the bottom and top closure flaps and tuck tabs can be inserted into the upper and lower ends of the carton, and will maintain the carton in an erected condition.

If desired, panel sections 10 and 12 may be provided with aligned openings 40 for use in hanging the panel and carton on a hook for display purposes.

It will be appreciated that the novel panel and carton has two primary advantages over the known prior art. First, the utilization of a portion 19 of the panel rear section as the rear wall of the carton reduces the amount of paperboard required to form the structure.

Second, and even more important, is the fact that by sandwiching the carton retaining flap 26 between the panel sections 10 and 12, flap 26 is not in any position to interfere with the mechanical closing of the carton upper closure flaps and tuck tab. Thus, when the tuck tab 32 is inserted into the upper end of the carton, it is free to slide down along the face of panel rear section exposed portion 19. This is extremely important when the carton is erected, filled, and closed on automatic closing equipment.

It will be understood (although not illustrated in the drawings) that the lower end of carton C may be closed by a conventional seal end structure arrangement instead of the tuck flap closure arrangement employed at the upper end of the carton.

I claim:

1. A collapsible, combination folding carton and display panel formed from a unitary blank of foldable paperboard or the like, comprising:

a. a flat display panel including:

i. a rear section;

ii. a front section foldably connected at one side edge to one side edge of said rear section and disposed to overlie said rear section in face-to-face contact therewith;

iii. said front section having a portion cut away therefrom to expose a related portion of said rear section;

b. a tubular carton including:

i. a pair of opposed outboard and inboard side walls;

ii. a front wall foldably connected at opposite side edges to front edges of said side walls and being spaced directly above said exposed portion of said panel rear section, which rear section portion also serves as a rear wall of said carton;

iii. said outboard side wall being foldably connected at its rear edge to the other side edge of said panel rear section;

iv. means for closing the upper and lower ends of said carton after said carton has been affixed to said display panel, including an upper closure flap foldably connected to the carton front wall upper edge;

v. said upper closure flap including a tuck tab foldably connected thereto and adapted to be inserted into said carton adjacent said panel rear section exposed portion;

c. a relatively narrow, elongated carton retaining flap foldably connected at one side edge to the rear edge of said carton inboard side wall;

d. said retaining flap being sandwiched between and secured to said panel front and rear sections inboardly adjacent said carton inboard side wall to retain said carton in position on said panel without having any obstruction on said display panel in the area between said carton side walls to thereby facilitate machine closing of said carton upper closure flap tuck tab.

* * * * *